United States Patent [19]

Gerlier

[11] Patent Number: 5,076,441

[45] Date of Patent: Dec. 31, 1991

[54] DEVICE FOR THE ACCEPTANCE AND DELIVERY OF BANKNOTES AND PROCESS FOR ITS OPERATION

[75] Inventor: André Gerlier, Sciez, France

[73] Assignee: Landis & Gyr Betriebs AG, Zug, Switzerland

[21] Appl. No.: 462,741

[22] Filed: Jan. 9, 1990

[30] Foreign Application Priority Data

Jan. 26, 1989 [CH] Switzerland ..... 00233/89

[51] Int. Cl.[5] ..... B07C 5/36

[52] U.S. Cl. ..... 209/534; 902/12; 235/379

[58] Field of Search ..... 209/534; 271/3.1, 4; 235/379; 902/11, 12; 194/206, 207

[56] References Cited

U.S. PATENT DOCUMENTS

| | | | |
|---|---|---|---|
| 4,319,137 | 3/1983 | Nakamura et al. | 209/534 |
| 4,473,157 | 9/1984 | Hirose et al. | 209/534 |
| 4,479,049 | 10/1984 | Hirose | 209/534 X |
| 4,524,268 | 6/1985 | Fukatsu | 902/11 X |
| 4,863,038 | 9/1989 | Yoshikawa et al. | 209/534 |

FOREIGN PATENT DOCUMENTS

| | | | |
|---|---|---|---|
| 3222689A1 | 12/1982 | Fed. Rep. of Germany . | |
| 3519607A1 | 12/1985 | Fed. Rep. of Germany . | |
| 117832 | 5/1988 | Japan | 209/534 |
| 2122010A | 1/1984 | United Kingdom . | |
| 2197300A | 5/1988 | United Kingdom . | |

*Primary Examiner*—Donald T. Hajec

*Attorney, Agent, or Firm*—Marmorek, Guttman & Rubenstein

[57] ABSTRACT

A device for accepting, storing, and delivering a predetermined set of banknotes comprises a housing, a deposit opening, a delivery opening, a testing mechanism for determining the denomination of the banknotes, a banknote stockpile for storing the banknotes, and a conveying system which conveys the banknotes within the device. The banknote stockpile comprises a till having a till switch located at the till output. The conveying system includes various segments, switches, and inlets which interconnect the deposit opening, the testing mechanism, the till input, the till output, and the delivery opening. The device further includes a control system which controls the travel of the banknotes along the conveying system so that the banknotes are conveyed from the deposite opening through the testing mechanism to the till input, from the till output through the testing mechanism to the delivery opening, and from the till output back to the till input in order to restack the banknotes in the banknote stockpile. In one embodiment, the device further includes a return receptacle and a return switch located at the output of the testing mechanism so that the control system delivers unidentified banknotes to the return receptacle. In another embodiment, the banknote stockpile includes two identical tills, and the conveying system includes segments connecting the till outputs of each to the till inputs of the other. The control system can then deliver banknotes of predetermined denomination from the most convenient till, or can restack the banknotes between the two tills.

27 Claims, 2 Drawing Sheets

DEVICE FOR THE ACCEPTANCE AND DELIVERY OF BANKNOTES AND PROCESS FOR ITS OPERATION

BACKGROUND OF THE INVENTION

The instant invention relates to a device for the acceptance and delivery of banknotes, the device having a mechanism for testing the banknotes, a banknote stockpile for storing and dispensing the banknotes, a conveyor system, and a control device for controlling the movement of the banknotes on the conveyor system of the device.

Such devices for the acceptance and delivery of banknotes are used advantageously in automatic service machines of all types, in particular in the area of banking and money changing.

A device for the acceptance and delivery of banknotes of this general type is known from German patent DE-PS 35 19 607 and is equipped with a set number of supply containers for banknotes, where each container holds only banknotes of the same denomination. The banknotes are checked only upon acceptance by a testing device. When they are delivered, the banknotes are taken from the appropriate containers, are bundled together in a stacking wheel and are delivered to the user of the device in the form of a bundle.

A device for the acceptance and delivery of banknotes is furthermore known from German patent DE-PS 32 22 689. It is equipped with one single testing device for the control of acceptance and delivery of the banknotes, with separate tills for the acceptance and delivery of banknotes. The cash stockpile for delivery comprises a set number of supply containers, each of which contains only banknotes of one and the same denomination.

A testing device is known from U.S. Pat. No. 4,319,137 which ascertains the genuine character and the orientation of a banknote by optical scanning of the printed image. The banknote may only be oriented according to the outer form in the reading plane of the testing device, a certain amount of lateral offset being compensated electronically. The scanning result is compared with samples from a preselected set of denominations. The banknotes are conveyed by means of endless belts.

A magnetic scanning system of the printed image of a banknote is also known from Swiss patent CH-PS 662,194, which uses the magnetic properties of certain printing inks.

The Swiss patent application 00 057/89-9 describes a device used to rotate and turn over banknotes so as to bring them into one and the same predetermined orientation for stacking. The turning device is also described in U.S. Pat. application Ser. No. 443,927, filed Nov. 30, 1989, which is incorporated herein.

The instant invention has a its object to provide a device which accepts banknotes of different denominations and sizes mechanically, controls and stores them, and delivers them to a user at the appropriate time, as well as a process for the operation of the device.

SUMMARY OF THE INVENTION

In accordance with the present invention, a device for accepting, storing, and delivering a predetermined set of banknotes comprises a housing, a deposit opening in the housing for receiving banknotes, a delivery opening for delivering banknotes, a testing mechanism for determining the denomination of the banknotes, a banknote stockpile for storing the banknotes, and a conveying system which conveys the banknotes within the device. The banknote stockpile comprises a till having a till input, a till output, and a till switch located at the till output. The conveying system includes various segments, switches, and inlets which interconnect the deposit opening, the testing mechanism, the till input, the till output, and the delivery opening. The device further includes a control system which controls the travel of the banknotes along the conveying system so that the banknotes are conveyed from the deposit opening through the testing mechanism to the till input, from the till output through the testing mechanism to the delivery opening, and from the till output back to the till input in order to restack the banknotes in the banknote stockpile. In one embodiment of the invention, the device further includes a return receptacle and return switch located at the output of the testing mechanism so that the control system delivers unidentified banknotes to the return receptacle. In another embodiment of the invention, the banknote stockpile includes two identical tills, and the conveying system includes segments connecting the till outputs of each to the till inputs of the other. The control system can then deliver banknotes of predetermined denomination from the most convenient till, or can restack the banknotes between the two tills.

In accordance with another aspect of the present invention, a process for accepting, storing, and delivering banknotes comprises accepting banknotes in a deposit opening, testing the banknotes by scanning at least one side of the banknotes, comparing the scanned side with a preselected set of stored banknotes and generating value signals corresponding to the denomination, the type and the orientation of the banknotes, transporting the banknotes along a conveying system in response to the value signals, and stacking the banknotes in a banknote stockpile. The process further comprises restacking the banknotes so that a banknote of preselected denomination is available for delivery, and so that unidentified banknotes are removed from the banknote stockpile, withdrawing the banknote of preselected denomination from the banknote stockpile, testing the banknote of preselected denomination, and delivering the banknote of preselected denomination to a delivery opening.

BRIEF DESCRIPTION OF THE DRAWINGS

Embodiments of the invention are described in greater detail below through the drawings as follows.

DETAILED DESCRIPTION OF EMBODIMENTS

Figure 1:
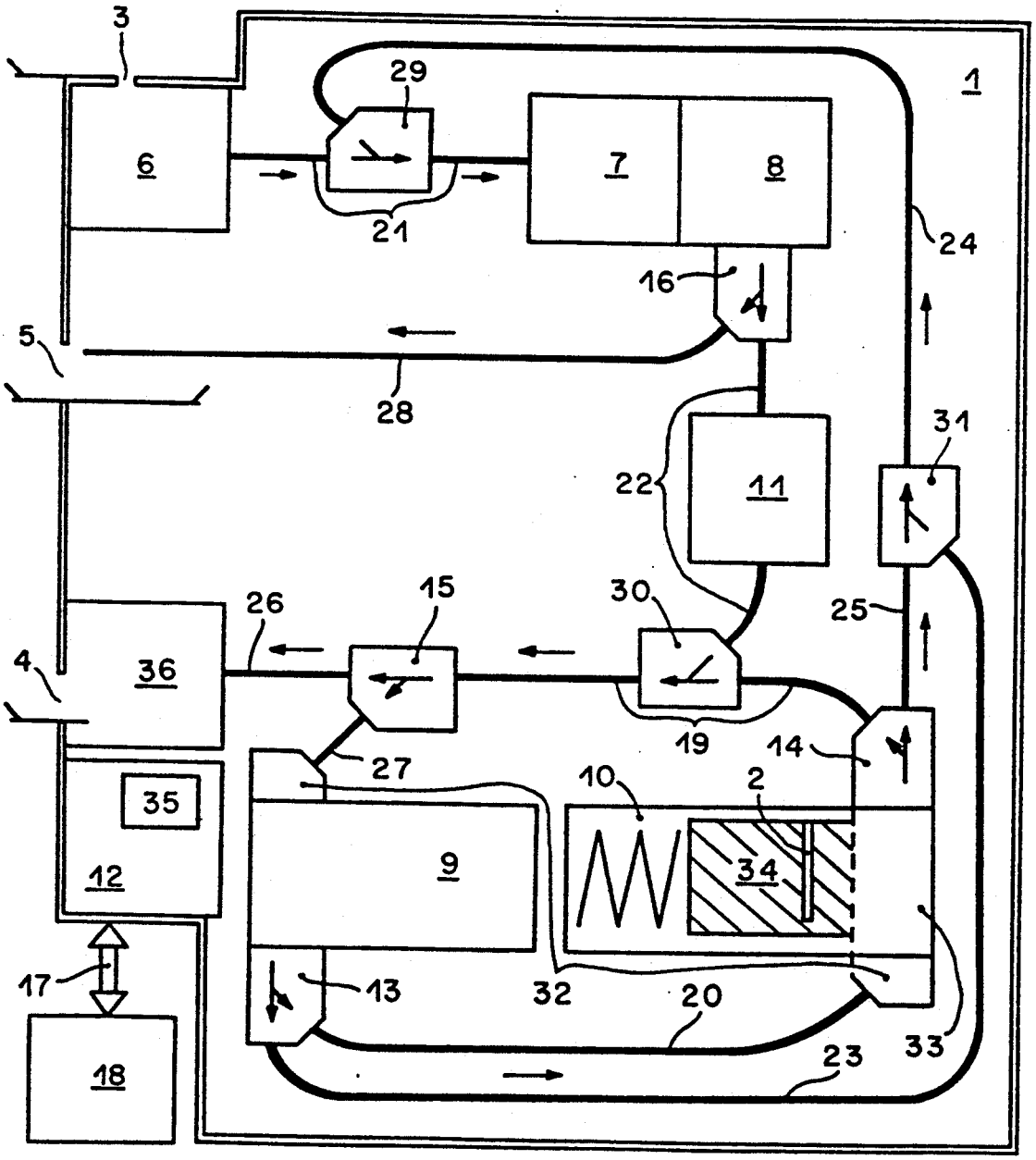
FIG. 1 schematically shows an embodiment of the inventive device with two separate tills.

In FIG. 1, the reference 1 designates a device for the mechanical acceptance and delivery of banknotes 2 of different denominations (different nominal values in at least one currency), 3 designates an input opening, 4 a delivery opening, 5 a return receptacle, 6 a separator, 7 an orientation path, 8 a testing device, 9 a first till, 10 a second till, and 11 a turning device for orienting the banknotes.

A control mechanism 12 is connected to the components of the device 1 by means of circuits which are not shown here for the sake of greater clarity in the drawing, e.g., it is connected to the testing device 8, to a banknote stockpile described further below, to first and second till switches 13 and 14, to a delivery switch 15, and to a return switch 16.

Each switch 13 to 16 is provided with a drive device which is influenced by the control mechanism 12, such as an electric motor, a pulling solenoid, etc., which switches the path of the banknote 2 in each of the switches 13 to 16 from its input to one or the other of its two branches. The control mechanism 12 selects one of the predetermined paths of the banknote 2 as a function of the signals and information it receives an switches the orientation of the switches 13 to 16 into a predetermined position.

Sensors (not shown here) of the control mechanism 12 serve to monitor path segments and to control drive motors (not shown) of a conveying system of the device 1. The drive motors are switched on and off as needed by the control mechanism 12 and, with the exception of the turning device 11, cannot be switched over in normal operation.

The control mechanism 12 also exchanges information via a bidirectional data path 17 with I/O devices 18 which are symbolically represented by one single rectangle. Several devices 18 are either set up separately or ar installed in the same housing as device 1. The conveying system of the device 1 comprises in a first embodiment a first conveyor belt 19, a second conveyor belt 20, a conveying path 21, a conveying path 27 and a return path 28. These are indicated in the drawing only by a broad line for the sake of greater clarity. Arrows drawn parallel to these lines indicate the conveying direction wherever this is required for greater clarity. The switches 13 to 16 and three inlets 29 to 31 are also part of the conveying system.

The above-mentioned banknote stockpile stores banknotes 2 of all predetermined denominations which have been accepted by the device 1 and delivers them upon demand. In a first embodiment, the banknote stockpile comprises two essentially identical tills 9 and 10, the till switches 13 and 14, the second conveyor belt 20, the belt conveyor 23, the connecting path 25, and the third inlet 31. Each till 9 and 10 has a till input 32, a till head 33 and the till switch 13 or 14 at the outlet. A mechanism (not shown) in each till head 33 deposits the banknote 2 which arrives through the till input 32 onto a till stack 34. A spring, for example, presses the till stack 34 against the mechanism in the till head 33 so that it may accept the uppermost banknote 2 from the till stack 34 and may introduce it into the input of the till switch 13 or 14. Only in the second till 10, shown schematically in cross-section, are reference numbers provided for the till head 33 and for the till stack 34.

The conveying system comprises an arrangement of endless, parallel running belts which go over rollers, cylinders, guiding plates, drive motors and additional elements known in conveying technology. The cylinders and rollers all rotate around axes which are perpendicular to the drawing plane in FIGS. 1 to 3, for example.

The conveying system conveys sheet-like items within a preselected range of dimensions, such as banknotes 2 of different denominations. The items are held between conveying belts arranged in pairs or between belts and cylinders and are conveyed from the input opening 3 through the testing device 8 to the input of the banknote stockpile, from an output of the banknote stockpile through the testing device 8 to the delivery opening 4, from the testing device 8 to the return receptacle 5, or from the output of the banknote stockpile back to its input when restacking is required.

The conveying path 21 extends from the separator 6, which is placed directly behind the input opening 3, through a first inlet 29 and the orienting path 7 to the testing device 8.

An output of the testing device 8 leads into the input of the return switch 16. The conveying path 22 connects a branch of the return switch 16 through the turning device 11 to an input of the second inlet 30, while a second branch of the return switch 16 extends via the return path 28 to the return receptacle 5.

One branch of each till switch 13 or 14 of the tills 9 and 10 is connected by the conveyor belt 20 or by the belts 19 and 27 to the till input 32 of the other till 10 or 9. The belt conveyor 23 and the connecting path 25 constitute the two other branches of the till switches 13 and 14, and lead into the third inlet 31 going to the conveyor 24. Conveyor 24 extends from the output of the third inlet 31 to one of the inputs of the first inlet 29. The first inlet 29 makes it possible to introduce the banknotes 2 from the conveyor 24 into the conveying path 21 which conveys the sheet-like items through the orienting path 7 to the testing device 8.

The first conveyor path 19 goes through the second inlet 30. The conveying path 22 leads towards first till 9 via second inlet 30 where it meets with the first conveyor path 19. At the end of the first conveyor path 19, there is the delivery switch 15, one branch of which leads via conveyor belt 27 into the till input 32 of the first till 9, and the other branch of which, designated delivery path 26, leads to the delivery opening 4.

A user of the device 1 can learn from an instruction board, for example, which types of banknotes 2 are recognized by the device 1. The user places one or several of these banknotes which must merely be aligned according to their outer configuration into the input opening 3. The banknotes 2 may be mixed randomly and comprise, for example, several denominations and/or issues of different banknote-issuing institutions. The device 1 is therefore suitable as a banknote changer, e.g. in areas near a country border or in international airports and railroad stations where banknotes of other countries are frequently in circulation. Upon a command of the control mechanism 12 the separator 6 seizes for instance the lowest banknote 2 in the input opening 3 and introduces it into the conveying path 21. The banknote 2 travels through the first inlet 29 and into the orienting path 7. The orienting path 7 orients for example the long side of banknote 2 so that it is exactly parallel to the conveying direction of the conveying path 21 and transmits the oriented banknote 2 to the testing device 8. As soon as the conveying path 21 is free and at least one additional banknote 2 is present in the input opening 3, the separator 6 introduces the next banknote into the conveying path 21.

The testing device 8 optically and/or magnetically scans a printed image on at least one side of the banknote 2. The recorded pattern is compared with a predetermined set of stored pictures of the banknotes 2 to be accepted and in this way the testing device 8 ascertains the unit denomination, the type and the orientation of the banknote 2.

Damaged or counterfeit banknotes or those which cannot be identified as well as denominations which are not included in the predetermined set are classified as non-identifiable items as if they were blank paper of matching size.

It is advantageous also to determine the length and the width of the banknote 2, since this information limits considerably the number of denominations belonging to the predetermined set having to be recognized by the device 1 and thus expedites the identification of the banknote type. A further, advantageous shortening of the testing period for a banknote 2 is achieved if the testing device 8 which scans the banknotes 2 in both processes decides on the basis of this process of measuring whether the result of the optical or of the magnetic scanning is to be evaluated.

Another embodiment of the testing device 8 monitors the thickness of the conveyed items which ca be measured mechanically, for example, or by means of an optical determination of the transparency of the banknote 2. The monitoring of the thickness prevents two or more banknotes 2 lying on top of each other from being accepted.

Each test result is transmitted to the control mechanism 12 by means of a value signal. The value signal determines in the control mechanism 12 the path of the item in the conveying system of the device 1 and its destination.

Non-identifiable items are guided via delivery switch 16 into the return path 28 which conveys them into the return receptacle 5.

If a banknote 2 of predetermined denomination is recognized as being authentic and is accepted by the device 1, the control mechanism 12 credits the user for an amount equal to the value of the accepted banknote 2. This credit can be displayed by means of one of the devices 18, for example.

In such case, the control mechanism 12 guides this banknote 2 by means of the return switch 16 into the conveying path 22. The turning device 11, under the control of the control mechanism 12 places the banknote 2 into a predetermined orientation for storage. At the end of the conveying path 22 the banknote 2 is funnelled by means of the second inlet 30 into the first conveyor belt 19 and is conveyed from there by means of the delivery switch 15 via conveyor belt 27 through the till input 32 into the till head 33 of the first till 9. The mechanism in the till head 33 deposits the banknote 2 on top of the till stack 34 of first till 9.

After the banknotes 2 coming from the input opening 3 have been deposited in the first till 9, the control mechanism 12 decides on the subsequent steps according to the instructions received via the bidirectional data path 17 from one of the devices 18.

Thus, for example, the device 1 can issue the user by means of one of the devices 18 with a receipt for the money deposited and can credit the deposited amount to his account, the number of which is entered by means of a keyboard of one of the devices 18, not shown here, in accordance with a display. Conversely, the user can also withdraw an amount from his account by means of the device 1 or can exchange the banknotes 2 deposited through the input opening 3 into others banknotes. When another service is to be rendered, the device 1 can accept the banknotes 2 for payment, cause the service to be rendered and return whatever change is due on the banknotes.

In an advantageous embodiment, the device 1 is connected to an additional device 18 which consists of a delivery device for coins and which can give the user the remainder of the calculated change.

Upon a command issued by the control mechanism 12 for the delivery of a banknote 2, the mechanism in the till head 33 of the second till 10 introduces the uppermost banknote 2 of the till stack 34 into the till switch 14. Via connecting path 25 and the conveyor 24 this banknote 2 is conveyed to the testing device 8. If the banknote 2 is of a denomination suitable for delivery, the switches 16 and 15 guide the banknote 2, as it is conveyed out of the testing device 8, into the delivery path 26. If however the banknote 2 is not of a denomination suitable for delivery, said banknote 2 is guided back into the first till 9 by means of the switches 16 and 15. This process of restacking is continued until all the denominations suitable for delivery have been introduced into the delivery path 26. The advantage of this restacking process is demonstrated in a simple and low-cost embodiment of device 1, since only one single banknote stockpile of the kind described above is needed to store deposited banknotes 2 in a predetermined set of denominations and/or to deliver banknotes 2 of predetermined denominations.

If however the wrong banknote 2 has been taken from the first till 9 and has been conveyed via belt conveyor 23 and conveyor 24 to the testing device 8, this banknote 2 is conveyed through the till input 32 and through the till head 33 of the first till 9 to the first till switch 13 and is then conveyed via the second conveyor belt 20 through the till input 32 to the second till 10 where the banknote 2 is deposited by the mechanism of the till head 33 on the till stack 34.

After each storage or each delivery of a banknote 2 from the banknote stockpile, it is advantageous for the value signal and a code number which determines the position of the banknote in the banknote stockpile in relation to the other banknotes 2 of the till stack 34 to be entered in a memory section 35 of the control mechanism 12 or to be erased, and for the code number of all the banknotes remaining in the banknote stockpile to be corrected. The control device 12 examines the memory section 35 before delivery of banknotes 2 and determines on the basis of the recorded sequence of denominations from which till, 9 or 10, the banknotes will be taken.

If the uppermost banknote 2 on the till stack 34 of the till 9 or 10 selected by the control mechanism 12 is a wrong one this banknote 2 is taken via conveyor belt 20 or via the belts 19 and 27 directly from the till stack 34 into the other till 9 or 10. Possibly after several repetitions of this process, a banknote 2 which is suitable for delivery is uncovered as the uppermost on the till stack 34 and is conveyed to the testing device 8. On the other hand, however, the user may also be informed of the impossibility to carry out the desired transaction if the tills 9 and 10 contain no o too few banknotes 2 in the desired denominations.

The banknote stockpile has a capacity of a few thousand banknotes 2, representing the maximum capacity of one single till stack 34. In the extreme case, the entire contents of the banknote stockpile are located in on single till stack 34 after restacking the entire stockpile of banknotes 2 to uncover a suitable denomination.

Before delivery of the banknote 2 the control mechanism 12 receives a command from one of the devices 18, for example, to pay out a predetermined amount. The control mechanism 12 advantageously optimizes the delivery on the basis of the information contained in the memory section 35 so that a minimum number of banknotes 2 have to be given out from the tills 9 and 10, with the delivery being supplied from the till 9 or 10 with as few banknotes 2 as possible having to be shifted from one till 9 or 10 to the other till 9 or 10. It would also be possible to enter the desired breakdown of the amount to be delivered on a keyboard of device 18.

As soon as all banknotes 2 provided for delivery have been conveyed via delivery path 26 to the delivery opening 4 and all instructions have been processed, the control mechanism 12 decides whether banknotes 2 should be shifted between the tills 9 or 10 so that both tills 9 and 10 may contain approximately the same number of banknotes 2.

It is possible that a great number of banknotes 2 are given to the user at delivery. In an advantageous embodiment of the device 1, the delivery path 26 ends therefore in a stacker 36. It collects the banknotes 2 arriving one after the other and gives them to the user in the form of a stack pushed through the delivery opening 4 one at a time.

The first-time supply of the banknote stockpile consists of banknotes 2 of denominations in different proportions, depending on the type of use to which the device 1 is to be put. The control mechanism 12 advantageously keeps statistics on the number and type of accepted and delivered banknotes 2. The control 12 of the device 1 may be programmed to ascertain whether the composition of the till stack 34 is the best possible, or whether the proportion of certain denominations in the banknote stack must be increased. A further advantage over the existing state of the art is in the lengthening of the time periods between initial loading of the device 1 when the accepted banknotes 2 are deposited in the banknote stockpile and are made available for delivery, i.e, maintenance operations are reduced. In particular, delivery may be optimized so that the denominations which are available in excessive numbers according to the statistics are given preference for delivery.

During the delivery verification of non-identifiable items the latter are conveyed back to the banknote stockpile, and an error message is displayed, e.g., on one of the devices 18.

In a simplified embodiment the return switch 16, the return path 28, and the return receptacle 5 are omitted. The non-identified items may then be guided by the control mechanism 12 to the delivery opening 4 when non-identified banknotes 2 are deposited, but not when they are to be delivered from the banknote stockpile.

During the delivery verification of non-identifiable items, these items are advantageously separated from the banknote stockpile and are conveyed by means of the return switch 16 via return path 28 into a return receptacle 5 which is accessible only to control personnel. Upon their being deposited, the control mechanism 12 guides the non-identifiable items via conveying path 22 and conveyor belt 19 by mean of the delivery switch 15 to the delivery opening 4. This embodiment advantageously makes it possible to evaluate the reasons for rejection at a later point in time and relieves the banknote stockpile of non-identifiable items.

In a further embodiment of the device 1, the turning device 11 is omitted. This simplification is obtained at the cost of sacrificing rapidity during banknote distribution, since the testing device 8 must also determine the orientation of the banknotes 2 at delivery.

Figure 2:
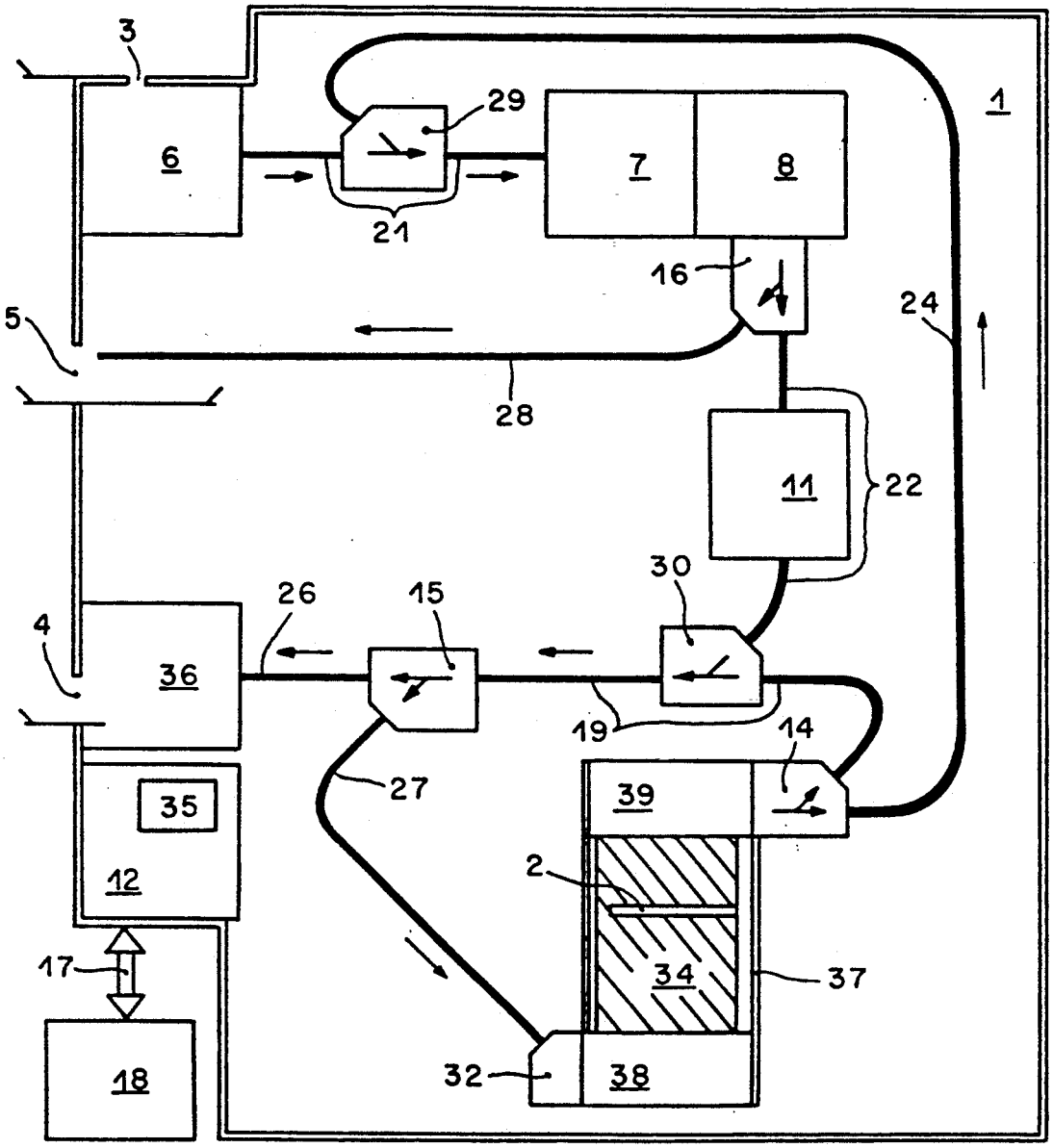
FIG. 2 shows another embodiment with one till.
Figure 3:
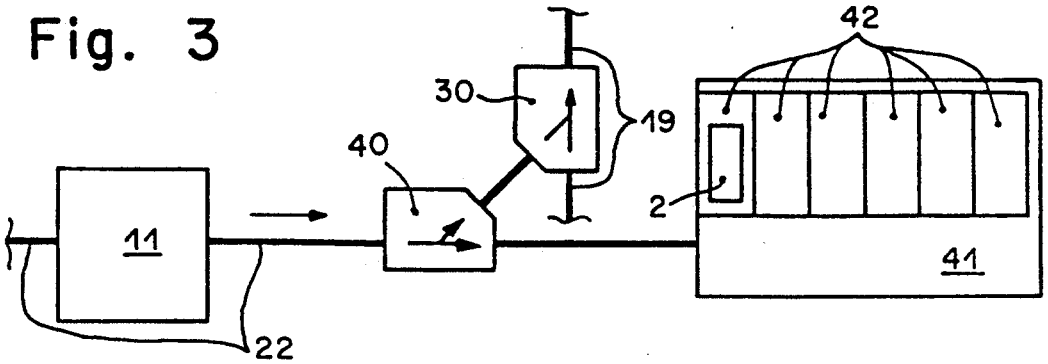
FIG. 3 shows additional equipment for the devices shown in FIGS. 1 and 2.

The device 1 of FIG. 2 is equipped with a simplified conveying system and with another banknote stockpile. The conveying system of the device 1 in this embodiment comprises only the switches 14 to 16, the conveyor belt 19, the conveying path 21, the conveying path 22, the conveyor 24, the delivery path 26, the conveyor belt 27, the return path 28 and the inlets 29 and 30. Compared with the embodiment according to FIG. 1, the second till switch 13, the third inlet 31 and the partial paths 20, 23 and 25 of the conveying system are omitted.

The banknote stockpile consists of only one single "first in - first out" till (FIFO till) 37 (FIG. 2). The sole till stack 34 in the FIFO till 37 is delimited from below at the till input 32 by means of a depositing device 38 and at the top by a withdrawal device 39. The withdrawal device 39 is provided on the output side with the single till switch 14. The contents of the banknote stockpile, i.e., the height of the till stack 34 determines the distance between the depositing device 38 and the withdrawal device 39. The depositing device 38 can be pressed by the force of a spring, for example, on the till stack 34 against the withdrawal device.

The till switch 14 is connected to the conveyor belt 19 via one branch. The other branch of till switch 14 leads directly into the conveyor 24 which establishes the connection to the testing device 8.

The delivery switch 15 is connected by one branch to the delivery path 26. The other branch of delivery switch 15 leads to the conveyor belt 27 which goes to the till input 32 and is equipped with a compensating element at the end near the till. It adapts to the changed position of the till input 32 which is determined by the variable height of the till stack 34.

For the other parts which are not mentioned the same reference numbers and the same designations apply in FIG. 2 as in FIG. 1.

When being received, a banknote 2 is conveyed via conveyor belt 27 into the FIFO till 37 and is deposited by the depositing device 38 so as to be the lowest in the till stack 34.

During delivery, the withdrawal device 39 takes the uppermost banknote from the till stack 34 at the command of the control mechanism 12 and introduces it into the till switch 14. The banknote 2 is delivered via till switch 14 to the conveyor 24 or to the conveyor belt 19. If the denomination of the uppermost banknote 2 does not match the preselected denomination, the banknotes 2 must be restacked via conveyor belt 19 and must change course via conveyor belt 27 until this requirement has been met. The advantage of the simplified and less expensive banknote stockpile is obtained at the cost of a delivery time that is slightly longer on average, since it is possible that the entire contents of the banknote stockpile may have to be shifted until the preselected denomination can be delivered.

In an advantageous embodiment of the device 1, an additional switch 40 is built in at the end of the conveying path 22, after the turning device 11 (FIG. 3), one branch of said switch 40 leading out into a container for banknotes 2 which are recognized by the testing device 8, but which the device 1 does not deliver, for reason of being foreign currency for example, and the other branch of which leads via the second inlet 30 to the conveyor belt 19 instead of to the container. The container is advantageously made in the form of a sorting device 41 with several stacking compartments 42 in order to deposit the banknotes 2 according to denominations and in a preselected orientation. The additional switch 40 and the sorting device 41 are connected via a circuit (not shown here) to the control mechanism 12.

The control mechanism 12 can also decide for example on the basis of the contents of its memory section 35 at what point in time and which banknotes 2 are to be taken from the banknote stack 34 and deposited in the preselected stacking compartments 42 (FIG. 3) so that the banknote stockpile may not be clogged up by too many banknotes of the same denomination. The advantages of a device 1 according to FIG. 3 consist in the longer period of time between maintenance operations, in the constantly optimized contents of the banknote stockpile, and in the bundles of banknotes 2 which are deposited in the stacking compartments 42 according to a predetermined orientation.

It is also possible to place items which are not identified at deposit into a preselected stacking compartment 42.

While the invention has been described by reference to specific embodiments, this was for purposes of illustration only and should not be construed as limiting the spirit or the scope of the invention. Numerous alternative embodiments will be apparent to those skilled in the art.

I claim:

1. A device for the acceptance and delivery of banknotes, comprising a housing, a deposit opening in said housing for receiving banknotes in said housing, a delivery opening in said housing for delivering banknotes out of said housing, testing means for determining the denomination of banknotes and for producing value signals in response thereto, a banknote stockpile for storing banknotes received in said deposit opening and for delivering banknotes to said delivery opening, a conveying system interconnecting said deposit opening, said testing means, said banknote stockpile, and said delivery opening along which said banknotes are conveyed, said banknote stockpile comprising at least one till having a till input, a till output, and a till switch having first and second branches located at said till output, said conveying system comprising a first segment connecting said delivery opening to said testing means, a first inlet along said first segment, a second segment leading towards said till input and terminating in a delivery switch said delivery switch having first and second branches, a second inlet located along said second segment, a third segment connecting said testing means to said second segment through said second inlet, a fourth segment connecting said first branch of said delivery switch to said delivery opening, a fifth segment connecting said second branch of said delivery switch to said till input, a sixth segment connecting said first branch of said till switch to said testing means via said first inlet and said first segment, the second branch of said till switch at said till output leading into said till input via said second segment, said delivery switch, and said fifth segment, whereby restacking of banknotes in said till may occur, and drive means for driving banknotes along said conveying system, and control means connected to said testing means, to said till switch, to said delivery switch, and to said drive means, for controlling the travel of banknotes along said conveying system in response to said value signals received from said testing means, said control means including memory means for storing said value signals.

2. The device of claim 1 further comprising a return receptacle in said housing, said conveying system further comprising a seventh segment leading to said return receptacle, and a return switch located at an output of said testing means, a first branch of said return switch leading to said third segment, and a second branch of said return switch leading to said seventh segment, said control means being connected to said return switch for delivering banknotes to said return receptacle in response to said value signals received from said testing means.

3. The device of claim 1 further comprising turning means disposed along said third segment for reorienting banknotes.

4. The device of claim 3 further comprising a sorting switch disposed along said third segment downstream of said turning means, and sorting means for sorting banknotes, a first branch of said sorting switch leading to said sorting means, and a second branch of said sorting switch leading back into said third segment, said control means being connected to said sorting switch and to said sorting means to control operation thereof.

5. The device of claim 1 further comprising stacking means disposed along said fourth segment for stacking banknotes prior to delivery of said banknotes to said delivery opening.

6. The device of claim 1 wherein said till further comprises depositing means located at said till input for depositing banknotes within said till, and withdrawing means located at said till output for withdrawing banknotes from said till, said till switch being connected to said withdrawal means.

7. The device of any of claims 1 to 6, wherein said at least one till comprises first and second substantially similar tills having first and second till inputs, first and second till outputs, first and second till heads, first and second till stacks, and first and second till switches respectively, said first and second till outputs being connected to said first and second till switches respectively, a third inlet of said conveyor system leading to said sixth segment, a first branch of said first till switch leading into said second till input, a second branch of said first till switch leading into said third inlet, a first branch of said second till switch leading into said third inlet, and a second branch of said second till switch leading into said first till input.

8. A process for accepting, storing, and delivering banknotes comprising, accepting banknotes in a deposit opening, testing said banknotes by scanning at least one side of said banknotes, comparing said scanned side with a preselected set of stored banknotes and generating value signals corresponding to the denomination, the type and the orientation of said banknotes, transporting said banknotes along a conveying system in response to said value signals, stacking said banknotes in a banknote stockpile, restacking said banknotes in said banknote stockpile so that a banknote of predetermined denomination is available for delivery, and so that unidentified banknotes are removed from said banknote stockpile, withdrawing said banknote of predetermined denomination from said banknote stockpile, testing said banknote of predetermined denomination, and delivering said banknote of predetermined denomination to a delivery opening.

9. The process of claim 8 wherein said banknotes are scanned optically.

10. The process of claim 8 wherein said banknotes are scanned magnetically.

11. The process of claim 8 further comprising storing in a memory means said value signals and code numbers which determine the position of each banknote stacked in said banknote stockpile, and updating said stored value signals and said code numbers as banknotes are deposited into, withdrawn from, or restacked in said banknote stockpile.

12. The process of claim 11 wherein said banknotes are transported along said conveying system in dependence upon said stored value signals and code numbers.

13. A device for accepting, storing and delivering a predetermined set of banknotes, comprising a housing, a deposit opening in said housing for receiving banknotes in said housing, a delivery opening in said housing for delivering banknotes from said housing, testing means for determining the denomination of banknotes within said housing and for producing value signals in response thereto, a banknote stockpile for storing banknotes in said housing and for delivering banknotes to said delivery opening, said banknote stockpile comprising at least one till having a till input, a till output, and a till switch having first and second branches located at said till output, a conveying system interconnecting said deposit opening, said testing means, said banknote stockpile, and said delivery opening along which said banknotes are conveyed, said conveying system comprising a first segment connecting said delivery opening to said testing means, a second segment connecting said testing means to a delivery switch having first and second branches, a third segment connecting said first branch of said delivery switch to said till input, a fourth segment connecting said first branch of said till switch to said second segment, a fifth segment connecting said second branch of said till switch to said testing means, and a sixth segment connecting said second branch of said delivery switch to said delivery opening, and drive means for driving said banknotes along said conveying means, and control means connected to said testing means, to said till switch, to said delivery switch, and to said drive means, for conveying banknotes from said deposit opening through said testing means to said till input, from said till output through said testing means to said delivery opening, and from said till output to said till input in order to restack said banknotes in said banknote stockpile, in response to said value signals received from said testing means.

14. The device of claim 13 wherein said control means includes memory means for storing said value signals and the order of banknotes stored in said banknote stockpile.

15. The device of claim 13 wherein said banknotes are stored in said till on a first-in, first-out basis.

16. The device of claim 13 further comprising an inlet located along said first segment and receiving banknotes from said deposit opening and from said fifth segment.

17. The device of claim 13 further comprising an inlet located along said second segment and receiving banknotes from said testing means and from said till switch.

18. The device of claim 13 further comprising a return receptacle in said housing, said conveying system further comprising a return switch located at an output of said testing means and a seventh segment connecting a first branch of said return switch to said return receptacle, a second branch of said return switch leading into said second segment, said control means being connected to said return switch for delivering banknotes to said return receptacle when said banknotes ar not part of said predetermined set.

19. The device of claim 13 further comprising turning means disposed along said second segment for reorienting banknotes.

20. The device of claim 19 further comprising a sorting switch disposed along said second segment downstream of said turning means, and sorting means for sorting banknotes, a first branch of said sorting switch leading to said sorting means, and a second branch of said sorting switch leading back into said second segment, said control means being connected to said sorting switch and to said sorting means to control operation thereof.

21. The device of claim 13 further comprising stacking means disposed along said sixth segment for stacking banknotes prior to delivery of said banknotes to said delivery opening.

22. The device of claim 13 wherein said till further comprises depositing means located at said till input for depositing banknotes within said till, and withdrawing means located at said till output for withdrawing banknotes from said till, said till switch being connected to said withdrawal means.

23. The device of any of claims 13 to 22, wherein said at least one till comprises first and second substantially similar tills having first and second till inputs, first and second till outputs, and first and second till switches respectively, said first and second till outputs being connected to said first and second till switches respectively, a first branch of said first till switch leading into said second till input, a second branch of said first till switch leading into said fifth segment, a first branch of said second till switch leading into said fifth segment, and a second branch of said second till switch leading into said first till input via said second segment.

24. A device for accepting, storing and delivering a predetermined set of banknotes, comprising a housing, a deposit opening in said housing for receiving banknotes in said housing, a delivery opening in said housing for delivering selected banknotes from said housing, testing means for determining the denomination of banknotes within said housing and for producing value signals in response thereto, a banknote stockpile means for storing banknotes of said predetermined set in said housing in a stack irrespective of their denominations, and for delivering said selected banknotes from said stack to said delivery opening, said banknote stockpile means comprising at least one till containing said stack having a till input, a till output, and a till switch having first and second branches located at said till output, a conveying system interconnecting said deposit opening, said testing means, said banknote stockpile means, and said delivery opening along which said banknotes are conveyed, and control means connected to said testing means, to said till switch, and to said conveyor system for conveying banknotes from said deposit opening through said testing means to said till input, from said till output through said testing means to said delivery opening, and from said till output to said till input in order to restack said banknotes in said banknote stockpile means while searching said stack for said selected banknotes, in response to said value signals received from said testing means.

25. The device of claim 24 wherein said control means includes memory means for storing said value signals and the order of banknotes stored in said banknote stockpile means.

26. The device of claim 24 further comprising a return receptacle in said housing said conveying system interconnecting said testing means to said return receptacle, said control means conveying banknotes to said return receptacle when said banknotes are not part of said predetermined set.

27. The device of claim 24, wherein said at least one till comprises first and second tills having first and second till inputs, first and second till outputs, and first and second till switches respectively, said conveying system interconnecting a first branch of each of said first and second till switches to said testing means, said conveying system further interconnecting a second branch of each of said first and second till switches to the till input of the other, said control means conveying banknotes from either of said first and second tills to said testing means, and from either of said first and second tills to the other, whereby restacking may occur.

* * * * *

UNITED STATES PATENT AND TRADEMARK OFFICE

CERTIFICATE OF CORRECTION

PATENT NO. : 5,076,441

DATED : December 31, 1991

INVENTOR(S) : Gerlier

It is certified that error appears in the above-indentified patent and that said Letters Patent is hereby corrected as shown below:

Column 1, line 57 "a" should be -- as --.

Column 5, line 15, "ca" should be -- can --.

Column 6, line 46, insert --,-- after "one".

Column 6, line 54, change "o" to -- or --.

Column 7, line 56, change "mean" to -- means --.

Column 9, line 8, change "consist" to -- consists--.

Claim 1, Column 9, line 46, change "delivery" to -- deposit --.

Claim 1, Column 9, line 49, change "switch" to -- switch, --.

Claim 18, Column 12, line 22, change "ar" to -- are --.

Claim 24, Column 13, line 4, delete "a" before "banknote".

Claim 26, Column 14, line 6, change "housing" to -- housing, --.

Signed and Sealed this

Thirteenth Day of September, 1994

*Attest:*

Bruce Lehman

BRUCE LEHMAN

*Attesting Officer*

*Commissioner of Patents and Trademarks*